US007452184B2

(12) United States Patent
Durocher et al.

(10) Patent No.: US 7,452,184 B2
(45) Date of Patent: Nov. 18, 2008

(54) AIRFOIL PLATFORM IMPINGEMENT COOLING

(75) Inventors: Eric Durocher, Vercheres (CA); Remy Synnott, St. Jean-sur-Richelieu (CA); Dany Blais, Ste. Julie (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 106 days.

(21) Appl. No.: 11/008,978

(22) Filed: Dec. 13, 2004

(65) Prior Publication Data

US 2006/0127212 A1 Jun. 15, 2006

(51) Int. Cl.
*F04D 31/00* (2006.01)

(52) U.S. Cl. ..... 415/191; 415/115; 415/199.5; 416/193 A

(58) Field of Classification Search ..... 415/115, 415/116, 191, 199.5; 416/97 R, 193 A
See application file for complete search history.

(56) References Cited

U.S. PATENT DOCUMENTS 3,791,758 A 2/1974 Jenkinson
4,302,148 A 11/1981 Tubbs
4,344,736 A 8/1982 Williamson
4,348,157 A 9/1982 Campbell et al.
4,375,891 A 3/1983 Pask
4,522,557 A 6/1985 Bouiller et al.
5,197,852 A 3/1993 Walker et al.
5,244,354 A * 9/1993 Nicol ..... 417/219
5,252,026 A 10/1993 Shepherd
5,470,198 A * 11/1995 Harrogate et al. ..... 415/115
5,967,745 A 10/1999 Tomita et al.
6,077,035 A 6/2000 Walters et al.
6,082,961 A * 7/2000 Anderson et al. ..... 415/115
6,126,390 A * 10/2000 Bock ..... 415/115
6,196,791 B1 3/2001 Tomita et al.
6,341,939 B1 * 1/2002 Lee ..... 416/97 R
6,416,284 B1 * 7/2002 Demers et al. ..... 416/97 R
7,001,141 B2 * 2/2006 Cervenka ..... 415/115

* cited by examiner

*Primary Examiner*—Igor Kershteyn
(74) *Attorney, Agent, or Firm*—Ogilvy Renault LLP

(57) ABSTRACT

A gas turbine engine airfoil has a platform cooling scheme including an impingement hole for directing cooling air against an undersurface of the airfoil platform.

7 Claims, 3 Drawing Sheets

AIRFOIL PLATFORM IMPINGEMENT COOLING

TECHNICAL FIELD

The invention relates generally to gas turbine engines and, more particularly, to airfoil platform impingement cooling.

BACKGROUND OF THE ART

Gas turbine engine airfoils, such as high pressure turbine vanes, are typically cooled by compressor bleed air. Conventional turbine vanes, such as the one shown at 9 in FIG. 1, generally have a radially inner band or platform 11 and a plenum 13 defined below the platform 11 for receiving the compressor bleed air. Film cooling holes 15 typically extend from the underside of the platform 11 to the platform radially outer surface 17 (i.e. the platform surface facing the hot gas stream). The air flowing from the holes 15 forms a thin cooling film on the radially outer surface 17 of the platform 11.

One disadvantage of the above vane cooling scheme is that it requires additional cooling air to purge the turbine cavity between the adjacent rows of vanes and turbine blades. Furthermore, the film cooling holes must be sufficiently long to allow the cooling air to flow from the plenum to the gas path side of the platform, which results in greater turbine vane manufacturing costs.

SUMMARY OF THE INVENTION

It is therefore an object of this invention to provide a new airfoil platform cooling system that addresses the above problems.

In one aspect, the present invention provides an airfoil for a gas turbine engine, the airfoil comprising at least a platform having a gas path side and a back side, an airfoil portion extending from the gas path side of the platform, and a plenum located on a side of the platform opposite said airfoil portion, the plenum communicating with a source of coolant, the plenum having an outlet hole extending through a wall thereof, the outlet hole having an exit facing the back side of the platform and oriented for directing the coolant thereagainst.

In another aspect, the present invention provides a turbine vane for a gas turbine engine, comprising: a platform having a gas path side, a back side opposite said gas path side, and an overhanging portion; an airfoil portion extending from said gas path side of said platform; a plenum located on the back side of the platform; and at least one impingement hole extending through a wall of the plenum and having an axis intersecting the overhanging portion of the platform for directing coolant from the plenum onto the back side of the overhanging portion.

In another aspect, the present invention provides a turbine section for a gas turbine engine, comprising a turbine nozzle adapted to direct a stream of hot combustion gases to a turbine rotor, the turbine rotor having a plurality of circumferentially distributed blades projecting radially outwardly from a rotor disk, the rotor disk having a front rotor disk cavity, the turbine nozzle comprising a plurality of vanes extending radially between inner and outer bands forming radially inner and outer boundaries for the stream of hot combustion gases, each of a plurality of said vanes having a plenum located radially inwardly of said inner band, and at least one impingement hole oriented to cause coolant in the plenum to impinge onto a radially inwardly facing surface of the inner band and then flow into the front rotor disk cavity intermediate the turbine nozzle and the turbine rotor to at least partly purge the cavity from the hot combustion gases.

In a still further general aspect, the present invention provides a method of cooling an overhanging portion of a platform of a turbine vane, comprising the steps of: a) feeding cooling air into a plenum located underneath the platform and b) causing at least part of the cooling air in the plenum to impinge onto an undersurface of the overhanging portion of the platform.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
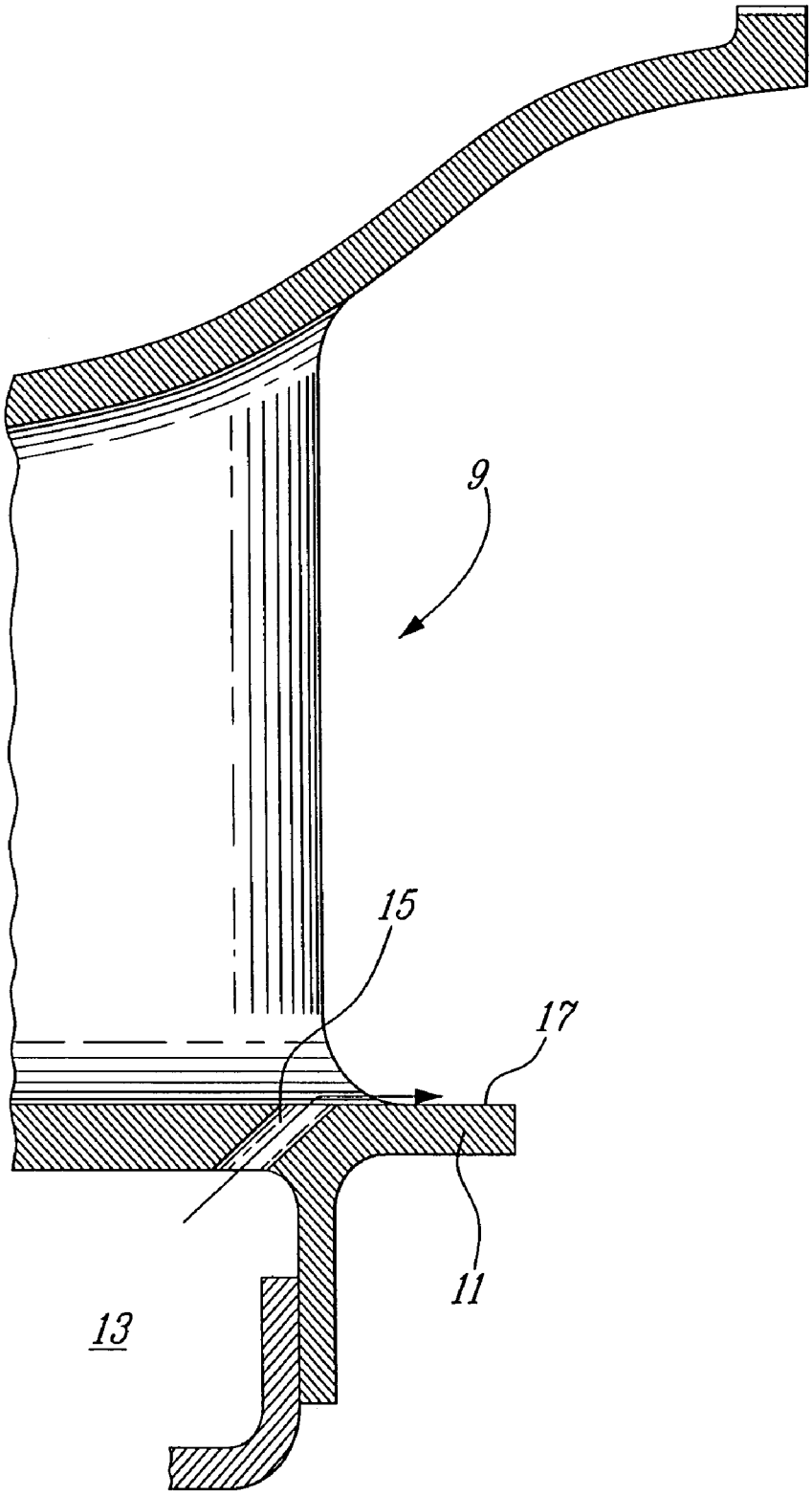
FIG. 1 (PRIOR ART)
FIG. 1 is a schematic cross-sectional side view of a conventional high pressure turbine vane having a platform with film cooling holes in accordance with the prior art.
Figure 2:
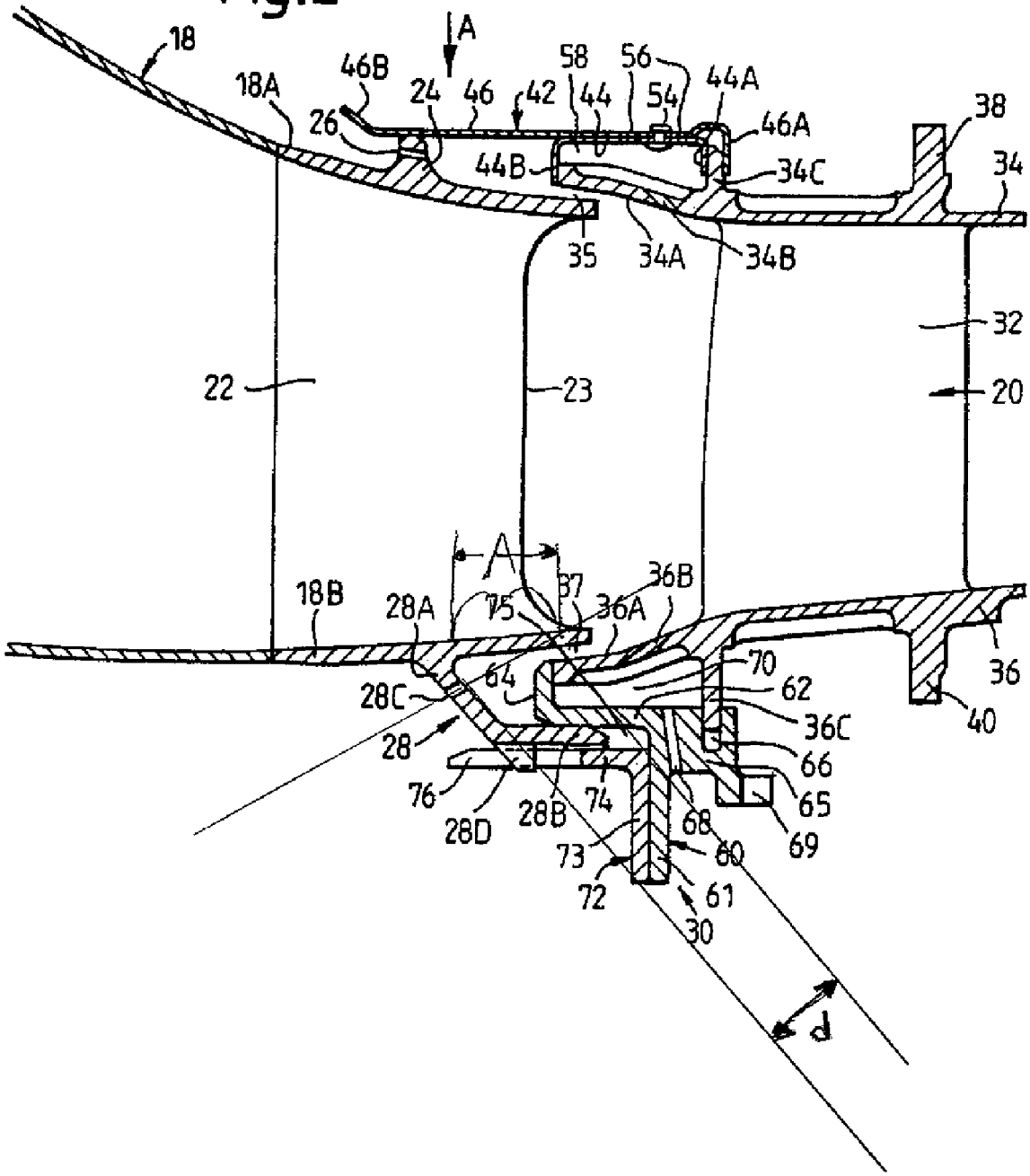
FIG. 2 is a cross-sectional side view of a gas turbine engine.

FIG. 2 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 3:
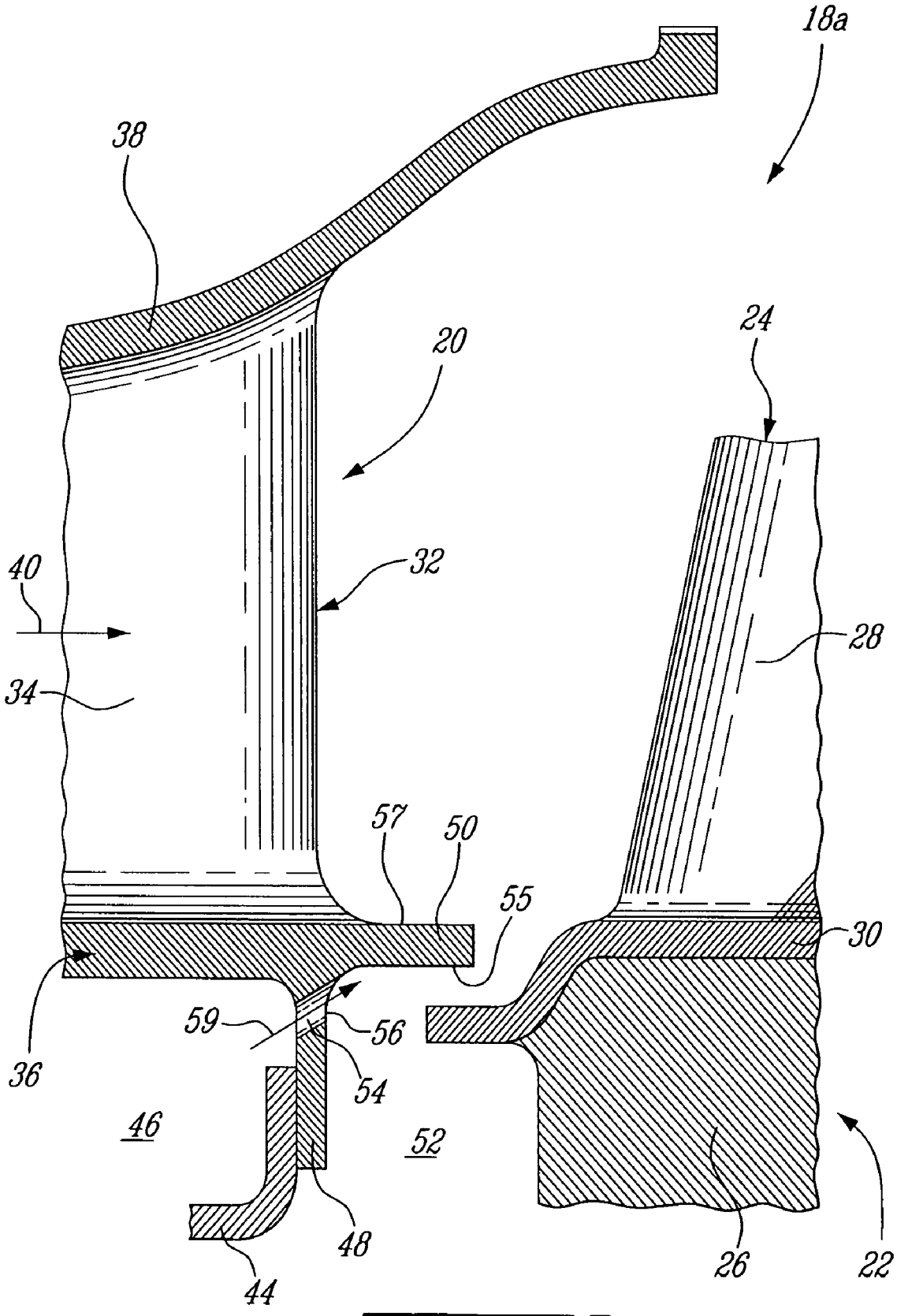
FIG. 3 is a schematic cross-sectional side view of a high pressure turbine section of the gas turbine engine shown in FIG. 2, illustrating a vane platform impingement cooling scheme in accordance with an embodiment of the present invention.

The turbine section 18 typically comprises a high pressure turbine 18*a* and a low pressure turbine 18*b* downstream of the high pressure turbine 18*a*. As shown in FIG. 3, the high pressure turbine 18*a* includes at least one turbine nozzle 20 and one turbine rotor 22. The turbine nozzle 20 is, configured to optimally direct the high pressure gases from the combustor 16 to the turbine rotor 22, as well know in the art.

The turbine rotor 22 includes a plurality of circumferentially spaced-apart blades 24 (only one shown in FIG. 3) extending radially outwardly from a rotor disk 26 mounted for rotation about a centerline axis of the engine 10. Each blade 24 includes and airfoil portion 28 extending from a gas path side of a blade platform 30, as well know in the art.

The turbine nozzle 20 includes a plurality of circumferentially spaced vanes 32 (only one shown in FIG. 3) having an airfoil portion 34 that extends radially between inner and outer arcuate bands (or platforms) 36 and 38. The airfoil portion 34, the inner band 36 and the outer band 38 are typically arranged into a plurality of circumferentially adjoining segments that collectively form a complete 360° assembly. The inner and outer bands 36 and 38 of each nozzle segments define the radially inner and outer flowpath boundaries for the hot gas stream flowing through the turbine nozzle 20 as represented by arrow 40.

The exemplary high pressure turbine vane 32 shown in FIG. 3 has a root portion 42 depending from the underside or back side of the radially inner band 36. The root portion 36 includes a mounting flange 48 adapted to be mounted to an inner ring support 44 by means know in the art. The root portion 36 defines a plenum 46, which is connected to a source of coolant, such as compressor bleed air. The rear mounting flange 48 forms part of the rear wall plenum. An aft axially extending portion of the inner band 36 projects axially rearward from the upper end of the mounting flange 48. The aft axially extending portion forms a band overhang 50 which slightly axially overlap the front portion of the platform 30 of the adjacent downstream turbine blade 24 to prevent direct ingestion of hot gases in the front rotor disk cavity 52 intermediate the turbine nozzle 20 and the turbine rotor 22.

As shown in FIG. 3, at least one impingement hole 54 extends at an angle through the rear wall 48 of the plenum 46. The axis of the hole 54 intersects the overhang 50. The hole 54 has an outlet 56 which is located below the undersurface or the back side 55 (i.e. the side opposite to the hot gas path side 57) of the overhang 50 of the inner platform 36. The hole 54 is oriented and configured so as to cause the cooling air in the plenum 46 to impinge onto the platform back side 55, thereby providing effective impingement cooling of the trailing edge portion of the platform 36. As opposed to conventional vane platform cooling configurations, no film cooling holes extends through the inner band 36 or platform to provide for the formation of thin cooling film on the gas path side 57.

In operation, cooling discharge air from the compressor flows into the through a cooling air circuit to plenum 46. The cooling air, as represented by arrow 59, then flow through the cooling hole 54 and impinges onto the back side 55 of the rear overhang 50. After cooling the platform overhang back side 55, the cooling air discharged from the impingement hole 54 flows into the front rotor disk cavity 52 to purge this space in order to limit ingestion of hot gases and, thus, prevent overheating of the rotor disk 26.

It can be readily appreciated that the above described cooling scheme advantageously provides for the efficient use of cooling air by allowing the same cooling air to be used for: 1) impingement cooling on the back side of the rear overhang 50 of the inner high pressure vane inner band, and 2) purging of the high pressure turbine front cavity 52 to minimizing cooling air consumption and avoid hot gas ingestion. This dual use of the cooling air provides a benefit to the overall engine aerodynamic efficiency by reducing the amount of cooling air required to cool the engine 10.

Furthermore, impingement holes 54 are shorter in length than conventional film cooling holes (0.15 inch to 0.25 inch as compared to 0.750 inch), which contributes to lower the vane manufacturing costs.

The above description is meant to be exemplary only, and one skilled in the art will recognize that changes may be made to the embodiments described without department from the scope of the invention disclosed. For example, it is understood that the impingement holes could be otherwise positioned and oriented to cool other portions of the inner vane platform. Also, while the invention as been described in the context of a high pressure turbine vane inner platform, it is understood that the same principles could be applied to other gas turbine engine airfoil structures, such as turbine blades. Still other modifications which fall within the scope of the present invention will be apparent to those skilled in the art, in light of a review of this disclosure, and such modifications are intended to fall within the appended claims.

The invention claimed is:

1. A gas turbine, engine comprising:

a compressor, a combustor receiving compressed air from the compressor, a series of turbine vanes for directing combustor gases from the combustor to a turbine rotor, each of the turbine vane having a radially inner platform having a gas path side, a back side opposite the gas path side, and an airfoil extending radially from the gas path side of the radially inner platform, the radially inner platform having an overhanging portion projecting axially downwardly beyond a trailing edge of the airfoil, the radially inner platform having a mounting flange depending radially inwardly from the back side of the radially inner platform, the turbine vanes and the turbine rotor defining therebetween a vane/rotor cavity, in use, the turbine rotor imparting a swirl to the air in the vane/rotor cavity, and a source of air for purging the vane/rotor cavity, said source of air including a plenum located radially inwardly of the radially inner platform, said plenum being in fluid flow communication with said vane/rotor cavity through at least one impingement hole defined through said mounting flange, said at least one impingement hole having an axis intersecting the overhanging portion so as to direct an impingement jet from the plenum onto the back side of the overhanging portion rearwardly of the trailing edge of the airfoil of the vane.

2. The gas turbine engine as defined in claim 1, wherein the axis of said impingement hole intersects the radially inner platform at a location closer to the mounting flange than a distal rear end portion of the radially inner platform.

3. The gas turbine engine as defined in claim 2, wherein said axis is slanted relative to said radially inner platform, and wherein said mounting flange is perpendicular to the radially inner platform.

4. The gas turbine engine as defined in claim 1, wherein the impingement hole is contiguous to a transition between the radially inner platform and the mounting flange.

5. The gas turbine engine as defined in claim 1, wherein the axis of said at least one impingement hole intersect the radially inner platform at a location spaced axially forwardly from a gap defined between axially overlapping portions of respective radially inner platforms of the turbine vanes and turbine blades of the turbine rotor.

6. The gas turbine engine defined in claim 1, wherein the mounting flange is perpendicular to the platform, and wherein the at least one impingement hole extends at an angle through the mounting flange.

7. The gas turbine engine defined in claim 1, wherein the trailing edge of the airfoil is upstream of a trailing edge of the overhanging portion of the radially inner platform so as to define a free end portion, and wherein the impingement occurs on the free end portion of the overhanging portion of the radially inner platform.

* * * * *